US010381212B1

(12) United States Patent
Fujita

(10) Patent No.: US 10,381,212 B1
(45) Date of Patent: Aug. 13, 2019

(54) TIME-OF-FLIGHT MASS SPECTROMETER

(71) Applicant: SHIMADZU CORPORATION, Kyoto-shi, Kyoto (JP)

(72) Inventor: Ryo Fujita, Kyoto (JP)

(73) Assignee: SHIMADZU CORPORATION, Kyoto-shi, Kyoto (JP)

( * ) Notice: Subject to any disclaimer, the term of this patent is extended or adjusted under 35 U.S.C. 154(b) by 0 days.

(21) Appl. No.: 15/891,445

(22) Filed: Feb. 8, 2018

(51) Int. Cl.
*H01J 49/00* (2006.01)
*H01J 49/40* (2006.01)

(52) U.S. Cl.
CPC ..... *H01J 49/403* (2013.01); *H01J 49/0086* (2013.01)

(58) Field of Classification Search
CPC ..... H01J 49/403; H01J 49/0086
USPC ..... 250/281, 282, 286, 287, 288
See application file for complete search history.

(56) References Cited

U.S. PATENT DOCUMENTS 6,717,132 B2 4/2004 Franzen
2008/0272287 A1* 11/2008 Vestal ..... H01J 49/40 250/282

* cited by examiner

*Primary Examiner* — Nicole M Ippolito
*Assistant Examiner* — Hanway Chang
(74) *Attorney, Agent, or Firm* — Sughrue Mion, PLLC

(57) ABSTRACT

A shielding plate 6 having a forward-side slit opening 61 and return-side slit opening 62 is placed in a free flight space 3 with no electric field. Ions which significantly deviate from a reference path are removed by the shielding plate 6 on both the forward-side and return-side paths. The opening width of the forward-side slit opening 61 is smaller than that of the return-side slit opening 62. Those opening widths and the placement position of the shielding plate 6 are determined based on the result of an ion trajectory calculation by accurate simulation. As compared to a conventional device with a shielding plate placed only on the return side, the present configuration allows for an increase in the opening width of the return-side slit opening while achieving the same level of resolving power. The ion transmission ratio is thereby improved, and the analytical sensitivity is enhanced.

5 Claims, 2 Drawing Sheets

TIME-OF-FLIGHT MASS SPECTROMETER

TECHNICAL FIELD

The present invention relates to a time-of-flight mass spectrometer, and more specifically, to a reflectron time-of-flight mass spectrometer using an ion reflector.

BACKGROUND ART

A time-of-flight mass spectrometer (which may be hereinafter abbreviated as the "TOFMS" according to a conventional usage) is a device in which various ions derived from a sample are made to fly a specific distance, and the time of flight is measured for each ion to calculate the mass-to-charge ratio m/z of the ion based on the fact that the flight speed of each ion depends on its mass-to-charge ratios when the ions are accelerated by the same amount of energy. In the TOFMS, the flight speed of an ion depends on the amount of initial energy imparted from an electric field or the like. Therefore, the mass-resolving power of the device is affected by the spread (variation) in the initial energy of an ion packet, i.e. a cluster of ions having the same mass-to-charge ratio.

One method for improving the energy convergence of the time of flight of ions to enhance the mass-resolving power is to adopt the configuration of a reflectron in which ions are made to fly a round trip by using an ion reflector which repels ions by an electric field. In the ion reflector, an ion having a greater amount of energy (and hence a higher flight speed) among the ions having the same mass-to-charge ratio takes a path which reaches a deeper point inside the ion reflector and turns around. Accordingly, among the ions having the same mass-to-charge ratio, an ion having a greater amount of energy effectively flies a longer distance than an ion having a smaller amount of energy, whereby the discrepancy in the time of flight due to the difference in the amount of energy is compensated for. That is to say, the energy convergence of the time of flight of the ions is improved.

However, there is a limit of the energy convergence by the ion reflector. Therefore, if the variation in the initial energy is equal to or greater than a certain extent, a considerable deviation of the flight trajectory occurs, causing a decrease in the mass-resolving power. Besides, in the reflectron TOFMS, the forward-side path along which ions fly from the ion ejector (which accelerates the ions and send them into the flight space) to the ion reflector should ideally lie on the same straight line as the return-side path along which the ions returned by the ion reflector travel to the detector. However, it is practically impossible to arrange the ion ejector and the detector on the same straight line. Accordingly, the ion ejector, ion reflector, detector and other related elements are normally arranged so that the forward-side and return-side paths will be approximately symmetrical with respect to the central axis of the ion reflector, as in a device described in Patent Literature 1 or other documents. Therefore, even the same kind of ions which have the same mass-to-charge ratio follow different flight paths if their initial positions at the time of acceleration are different. This results in a variation in the time of flight and causes a decrease in the resolving power.

To address such problems, in the TOFMS described in Patent Literature 1, a shielding plate with a slit opening having a predetermined shape and size (slit diaphragm) is placed in a free flight space in front of the detector. An ion following a deviated path which will lead to a decrease in the resolving power is thereby blocked and prevented from reaching the detector. Since the spatial spread of an ion packet is largest in the area in front of the detector, placing the shielding plate in front of the detector favorably minimizes the influence of the mechanical error of the slit opening on the resolving power. However, the use of such a shielding plate for blocking ions to improve the resolving power blocks more ions than necessary, i.e. including ions which are practically unlikely to decrease the resolving power. This causes the problem that the analytical sensitivity becomes lower due to the decrease in the amount of ions reaching the detector.

Although the TOFMS described in Patent Literature 1 is an orthogonal acceleration reflectron TOFMS, the previously described problem may also occur in a reflectron TOFMS different from the orthogonal acceleration type, such as a reflectron TOFMS in which ions are collectively ejected from an ion trap capable of accumulating ions and are made to fly, since the ion trap, ion reflector, detector and other related elements in this type of device are also normally arranged so that the forward-side and return-side paths will be approximately symmetrical with respect to the central axis of the ion reflector.

CITATION LIST

Patent Literature

Patent Literature 1: U.S. Pat. No. 6,717,132 B

SUMMARY OF INVENTION

Technical Problem

The present invention has been developed to solve the previously described problem. Its objective is to provide a reflectron time-of-flight mass spectrometer which can achieve high resolving power and high sensitivity by avoiding a decrease in the analytical sensitivity while ensuring a high level of resolving power.

Solution to Problem

The present invention developed for solving the previously described problem is a reflectron time-of-flight mass spectrometer including: a time-of-flight mass separator including a free flight space with no electric field and an ion reflector for reflecting an ion; an ion accelerator for accelerating an ion into the free flight space; and a detector for detecting an ion returning from a round trip in which the ion initially flies through the free flight space and once more flies through the free flight space after being reflected by the ion reflector. In the time-of-flight mass spectrometer:

a shielding plate is placed in the free flight space, the shielding plate having a forward-side opening located on a forward-side ion path directed from the ion accelerator to the ion reflector and a return-side opening located on a return-side ion path directed from the ion reflector and the detector; and the width of the forward-side opening of the shielding plate in the extending direction of a plane on which both the central axis of the forward-side ion path and the central axis of the return-side ion path lie is smaller than the width of the return-side opening in the same direction.

If the time-of-flight mass spectrometer according to the present invention is an orthogonal acceleration time-of-flight mass spectrometer, the ion accelerator is an orthogonal accelerator for accelerating an incident ion in a direction substantially orthogonal to the axis of incidence of the ion. If the time-of-flight mass spectrometer according to the present invention is an ion trap time-of-flight mass spectrometer, the ion accelerator is an ion trap (three-dimensional quadrupole ion trap or linear ion trap) for accelerating and ejecting ions after temporarily storing the ions. In the case of a time-of-flight mass spectrometer in which ions generated by an ion source employing a matrix assisted laser desorption/ionization (MALDI) or similar technique are made to fly, the ion accelerator is an acceleration electrode for extracting and accelerating ions generated by the ion source, from an area near a sample.

In the time-of-flight mass spectrometer according to the present invention, a shielding plate which is common to both the forward side on which ions travel from the ion accelerator to the ion reflector and the return side on which ions travel from the ion reflector to the detector is placed in the free flight space so that ions which may significantly lower the resolving power are blocked by the shielding plate on each of the two sides. Since the ions ejected from the ion accelerator vary in ejection angle primarily due to the variation in their amounts of initial energy, the ion packet gradually and spatially spreads during their flight. The spread of the ion packet on the forward side is smaller than on the return side. Accordingly, in a stage in which the spatial spread of the ion packet is relatively small, the shielding plate having a relatively small opening width is used to block ions which follow a path that may significantly lower the resolving power. On the return side, on which the ion packet that have been reflected by the ion reflector has a relatively large spatial spread, the shielding plate having a relatively large opening width is used to block ions which follow a path that may significantly lower the resolving power.

The opening widths of the forward-side and the return-side openings formed in the single shielding plate can be determined based on a simulation calculation of the ion trajectory using a computer. In recent years, the path which an ion departing from a specific initial position with a specific amount of initial energy may possibly follow can be calculated with a considerably high level of accuracy. Based on the calculated result of the ion path, the opening widths of each of the forward-side and return-side openings can be determined so as to block ions which do not fall within a predetermined permissible range from the time of flight of an ion which follows a reference path.

If a shielding plate having a slit opening is placed only on the return side as in the conventional TOFMS mentioned earlier, the opening width of the slit opening must be considerably small to enhance the resolving power. By comparison, in the time-of-flight mass spectrometer according to the present invention, since ions which follow significantly deviated paths are blocked on the forward side, the opening width of the slit opening on the return side can be larger than in the conventional TOFMS. The reason is as follows: In the conventional device, an ion following a significantly deviated path on the forward side may possibly come close to the reference path as a result of the correction of the path when the ion is reflected by the ion reflector, and such an ion also needs to be removed by the shielding place on the return side. By comparison, in the time-of-flight mass spectrometer according to the present invention, an ion which takes such a path does not need to be considered on the return side, since such an ion is removed on the forward side.

Advantageous Effects of the Invention

With the time-of-flight mass spectrometer according to the present invention, ions which may cause a decrease in the resolving power can be accurately removed in the middle of their flight in the free flight space. Therefore, it is possible to increase the amount of ions reaching the detector and thereby achieve a high level of analytical sensitivity while ensuring a high level of resolving power. The limitation of the spatial range for allowing ions to pass through on both the forward-side path and the return-side path is achieved with a single shielding plate. This reduces the cost of the shielding plate itself as well as the device production cost related to the attachment of the shielding plate.

DESCRIPTION OF EMBODIMENTS

A reflectron TOFMS as one embodiment of the present invention is hereinafter described with reference to the attached drawings.

Figure 1:
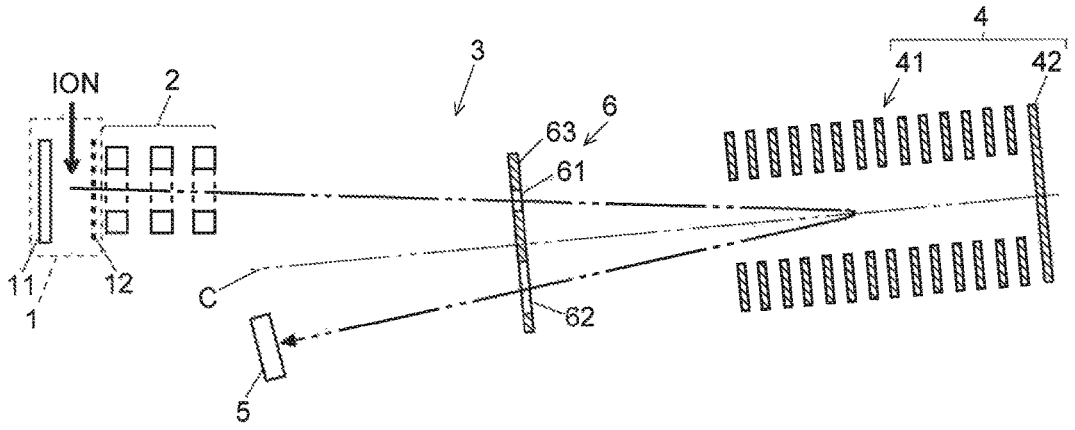
FIG. 1 is a schematic configuration diagram of a reflectron TOFMS as one embodiment of the present invention.

FIG. 1 is a schematic configuration diagram of the reflectron TOFMS in the present embodiment.

The reflectron TOFMS in the present embodiment is an orthogonal acceleration TOFMS. It includes: an orthogonal accelerator 1 including a plate-shaped push-out electrode 11 and a grid electrode 12; an ion-converging lens 2, which is an Einzel lens; a free flight space 3 with no electric field; an ion reflector 4 including a plurality of reflecting electrodes 41 and a back plate 42; and a detector 5 for detecting ions. Though not shown, the free flight space 3 and the ion reflector 4 are placed within a drift tube maintained in a high vacuum state.

An example of the reflecting electrode 41 is a plate-shaped electrode with a rectangular opening, as in the device described in Patent Literature 1. A plurality of reflecting electrodes 41 are arrayed along the central line C at predetermined intervals of space (there are a total of 14 electrodes in FIG. 1, but there is no restriction on this number). The back plate 42 with no opening is located at the farthest position as viewed from the side from which ions come. Different DC voltages are respectively applied from a voltage source (not shown) to the reflecting electrodes 41 and the back plate 42. By these voltages, a reflecting electric field for initially decelerating incident ions and subsequently reflecting and accelerating those ions is created within the rectangular columnar space formed by virtually connecting the rectangular openings of the reflecting electrodes 41.

An example of the detector 5 is an ion detector using a microchannel plate or secondary electron multiplier. It has a wide detection surface to efficiently detect a cluster of ions which are spatially spread to a certain extent when arriving at the detector.

Figure 2A:
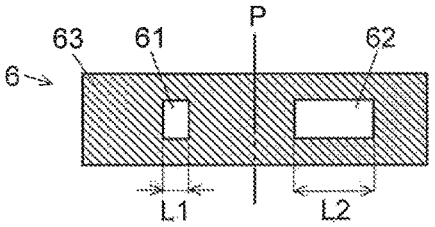
FIGS. 2A and 2B are plan views of shielding plates in the reflectron TOFMS in the present embodiment.

In the reflectron TOFMS in the present embodiment, a shielding plate 6 having a characteristic structure is placed in the free flight space 3 in order that ions which may cause a decrease in the resolving power due to a variation in the initial energy or initial position at the time of their acceleration will be removed in the middle of their flight. FIG. 2A is a plan view of the shielding plate 6 used in the TOFMS in the present embodiment. This shielding plate 6 is a plate-shaped member 63 in which two rectangular slit openings 61 and 62 having different opening widths L1 and L2 are asymmetrically formed with respect to the axis P. The slit opening 61 with opening width L1 corresponds to the forward-side opening in the present invention, while the slit opening 62 with opening width L2 corresponds to the return-side opening in the present invention. That is to say, the forward-side slit opening 61 is smaller in opening width than the return-side slit opening 62. This shielding plate 6 is placed so that the axis P coincides with the central line C of the reflecting electrodes 41.

The opening widths L1 and L2 of the slit openings 61 and 62 in the shielding plate 6 are determined based on an ion trajectory calculation by a simulation using a computer. In a calculation of ion trajectories by simulation, a considerably accurate calculation can be made for an ion flying along a specific path from a specific initial position with a specific amount of initial energy, to determine what amount of temporal difference from an ion traveling along the reference path the ion concerned will have in arriving at the detector. Accordingly, the initial position, initial energy, mass-to-charge-ratio range and other necessary conditions related to the ion packet are defined based on rough estimates determined from the results of a preliminary experiment or preliminary simulation calculation, and accurate ion trajectories are calculated under those conditions. Then, based on the calculated results, the placement position of the shielding plate 6 as well as the opening widths L1 and L2 of the slit openings 61 and 62 are determined so that the path of an ion whose temporal difference from the time of flight of an ion which follows the reference path is equal to or greater than a predetermined value will be blocked while an ion whose temporal difference is smaller than the predetermine value will pass through the slit openings and eventually reach the detector 5. The permissible value of the temporal difference of the time of flight can be set according to the desired level of the resolving power.

In the reflectron TOFMS in the present embodiment, ions which have entered the orthogonal accelerator 1 as indicated by the thick arrow in FIG. 1 are almost simultaneously accelerated in a direction substantially orthogonal to the axis of incidence of the ions by the DC electric field created by the DC voltages respectively applied to the push-out electrode 11 and the grid electrode 12. Thus, an ion packet including ions which fall within a predetermined mass-to-charge-ratio range is ejected from the orthogonal accelerator 1. After being converged by the ion-converging lens 2, the ion packet is sent into the free flight space 3 and arrives at the shielding plate 6. If there is an ion whose initial energy at the time of acceleration is significantly different from the reference value of the initial energy, or an ion whose initial position is significantly displaced from the reference point of the initial position, the path of the ion deviates from the reference path in the early phase of the flight. Accordingly, such an ion cannot pass through the forward-side slit opening 61 with the relatively small opening width L1 and is thereby removed.

The ion packet whose spatial spread has been limited through the forward-side slit opening 61 enters the ion reflector 4 and is returned by the reflecting electric field created within the reflector. In this process, an ion having the same mass-to-charge ratio as other ions yet having a greater amount of energy reaches a deeper point before being reflected. The reflected ions once more fly in the free flight space 3 and arrive at the shielding plate 6. Any ion which may possibly cause a decrease in the resolving power due to its path being deviated from the reference path cannot pass through the return-side slit opening 62 and is thereby removed.

If no removal of ions is performed on the forward-side path, there may be an ion which follows a path significantly deviated from the reference ion path on the forward side before entering the ion reflector 4 and then travels toward the detector 5 along a path which is corrected as a result of the reflection. In order to remove such an ion by a shielding plate placed on the return side, the slit opening on the return side must be small in width. By comparison, in the reflectron TOFMS in the present embodiment, ions which take eccentric paths which may possibly cause a decrease in the resolving power can be removed to a certain extent by the forward-side slit opening 61. This allows the return-side slit opening 62 to have a relatively large opening width L2. The transmission efficiency of the ions which will practically cause no decrease in the resolving power is thereby enhanced, so that a greater number of ions will be introduced into the detector 5, and a high level of analytical sensitivity will be achieved.

Figure 3A:
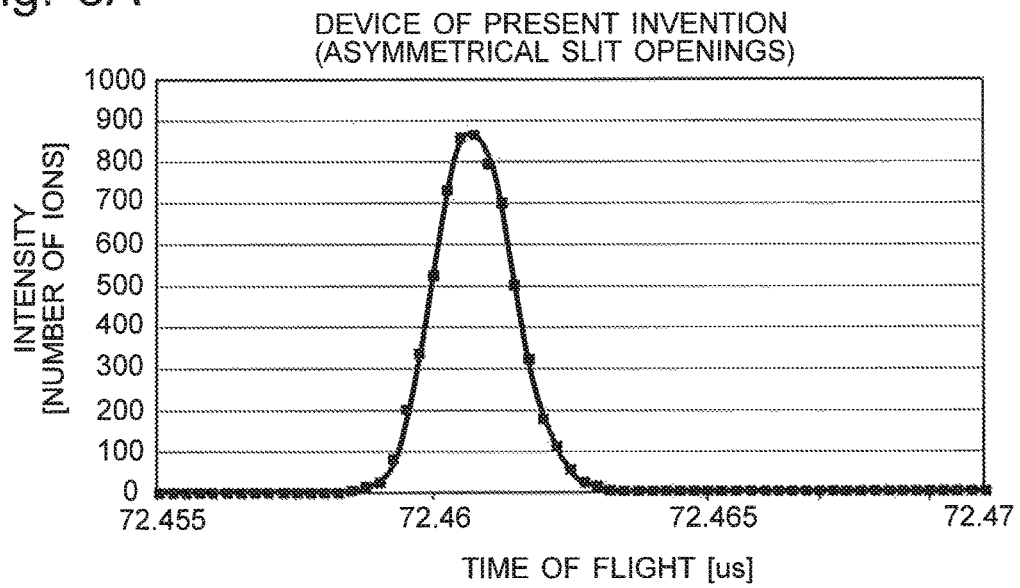
FIGS. 3A and 3B are time-of-flight spectra obtained by a simulation calculation in the reflectron TOFMS in the present embodiment and a conventional reflectron TOFMS.
Figure 3B:
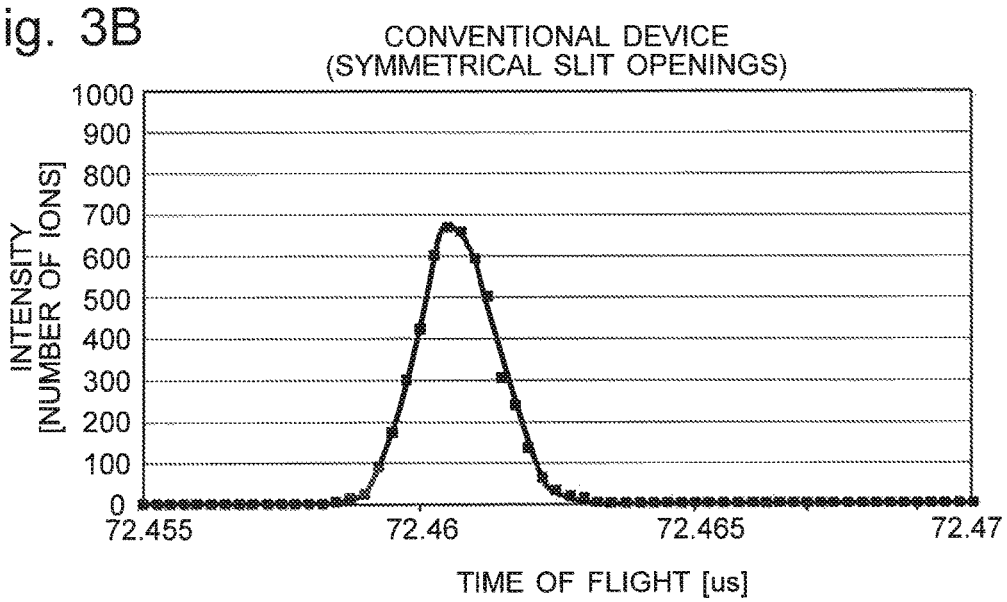

The present inventor has conducted a simulation calculation to confirm the difference in analytical sensitivity between the reflectron TOFMS in the present embodiment and a conventional reflectron TOFMS. FIGS. 3A and 3B are time-of-flight spectra obtained by the simulation calculation. The horizontal axis in the spectra indicates the time of flight, and the vertical axis indicates the number of ions which arrived at the detector 5.

FIG. 3B is the time-of-flight spectrum obtained in the case where a shielding plate having slit openings which were symmetrical with respect to the axis P (i.e. L1=L2) was used in place of a shielding plate having asymmetrical slit openings as shown in FIG. 2A. The shape of this shielding plate having the symmetrical slit openings was determined based on the result of an ion trajectory calculation by simulation so that a resolving power of 21000 would be achieved. According to the calculation, the ion transmission ratio in the present case was 35.8%. The resolving power was R=21700.

FIG. 3A is the time-of-flight spectrum in the reflectron TOFMS in the present embodiment. According to the calculation, the ion transmission ratio in the present case was 46.7%. The resolving power was R=21400. Thus, as compared to the case where the shielding plate having the symmetrical slit openings was used, the reflectron TOFMS in the present embodiment achieved an approximately 30% increase in the ion transmission ratio while maintaining almost the same level of resolving power. A difference in the ion transmission ratio almost directly turns into a difference in analytical sensitivity. Accordingly, it is possible to consider that the reflectron TOFMS in the present embodiment has the effect of enhancing the analytical sensitivity by approximately 30% as compared to the conventional device.

Figure 2B:
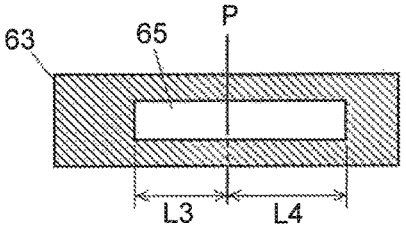

In the reflectron TOFMS in the previous embodiment, the forward-side slit opening 61 and the return-side slit opening 62 in the shielding plate 6 are completely separated from each other. It is possible to use a shielding plate in which the slit openings on both sides are connected to be a single asymmetrical slit opening 65 as shown in FIG. 2B.

It should be noted that the previous embodiment is one example of the present invention, and any change, modification or addition appropriately made within the spirit of the present invention will naturally fall within the scope of claims of the present application.

For example, although the previous embodiment is an orthogonal acceleration TOFMS, it is evident that the present invention is also applicable in a TOFMS in which ions temporarily stored in an ion trap are ejected from the ion trap and made to fly, or a TOFMS in which ions generated from a sample by an ion source employing the MALDI or similar technique are extracted from an area near the sample and accelerated into flight motion.

REFERENCE SIGNS LIST

1 . . . Orthogonal Accelerator
11 . . . Push-Out Electrode
12 . . . Grid Electrode
2 . . . Ion-Converging Electrode
3 . . . Free Flight Space
4 . . . Ion Reflector
41 . . . Reflecting Electrode
42 . . . Back Plate
5 . . . Detector
6 . . . Shielding Plate
61 . . . Forward-Side Slit Opening
62 . . . Return-Side Slit Opening
63 . . . Plate-Shaped Member
65 . . . Slit Opening
C . . . Central Line

The invention claimed is:

1. A reflectron time-of-flight mass spectrometer including: a time-of-flight mass separator including a free flight space with no electric field and an ion reflector for reflecting an ion; an ion accelerator for accelerating an ion into the free flight space; and a detector for detecting an ion returning from a round trip in which the ion initially flies through the free flight space and once more flies through the free flight space after being reflected by the ion reflector, wherein:

a shielding plate is placed in the free flight space, the shielding plate having a forward-side opening located on a forward-side ion path directed from the ion accelerator to the ion reflector and a return-side opening located on a return-side ion path directed from the ion reflector and the detector; and a width of the forward-side opening of the shielding plate in an extending direction of a plane on which both a central axis of the forward-side ion path and a central axis of the return-side ion path lie is smaller than a width of the return-side opening in the same direction.

2. The reflectron time-of-flight mass spectrometer according to claim 1, further comprising an ion-converging lens for converging a packet of ions.

3. The reflectron time-of-flight mass spectrometer according to claim 1, wherein the ion reflector comprises a plurality of reflecting electrodes arrayed along a central line at predetermined intervals.

4. The reflectron time-of-flight mass spectrometer according to claim 3, wherein the shielding plate is placed so that a center axis of the shielding plate aligns with the central line.

5. A reflectron time-of-flight mass spectrometer including: a time-of-flight mass separator including a free flight space with no electric field and an ion reflector for reflecting an ion; an ion accelerator for accelerating an ion into the free flight space; and a detector for detecting an ion returning from a round trip in which the ion initially flies through the free flight space and once more flies through the free flight space after being reflected by the ion reflector, wherein:

a shielding plate is placed in the free flight space, the shielding plate having a single asymmetrical opening through which ions received from a forward-side ion path directed from the ion accelerator to the ion reflector pass and through which ions returning from the reflector to a return-side ion path directed from the ion reflector and the detector pass, the single asymmetrical opening being asymmetrical with respect to a central line axis of reflecting electrodes of the ion reflector.

* * * * *